United States Patent [19]

Dulmaine et al.

[11] 4,096,814

[45] Jun. 27, 1978

[54] CONTAINER WITH OUTWARDLY FLEXIBLE BOTTOM END WALL HAVING INTEGRAL SUPPORT MEANS AND METHOD OF MANUFACTURE THEREFORE

[75] Inventors: Joseph Francis Dulmaine, Wheatridge; Michael Edward Bagrosky, Arvada, both of Colo.

[73] Assignee: Coors Container Company, Golden, Colo.

[21] Appl. No.: 763,293

[22] Filed: Jan. 27, 1977

Related U.S. Application Data

[62] Division of Ser. No. 631,539, Nov. 13, 1975, Pat. No. 4,037,752.

[51] Int. Cl.[2] ..... B21D 51/00

[52] U.S. Cl. ..... 113/120 M; 72/358

[58] Field of Search ..... 72/352, 358; 113/120 R, 113/120 M, 120 A; 220/66, 67, 70

[56] References Cited

U.S. PATENT DOCUMENTS

| | | | |
|---|---|---|---|
| 1,756,257 | 4/1930 | Neuberth | 72/358 |
| 3,155,055 | 11/1964 | Nishkian | 72/358 |
| 3,759,410 | 7/1973 | Uhlig | 220/70 |
| 3,814,040 | 6/1974 | Hobash | 113/120 M |

*Primary Examiner*—Leon Gilden

*Attorney, Agent, or Firm*—Bruce G. Klaas; Dennis K. Shelton

[57] ABSTRACT

A metallic container having an outwardly flexible bottom wall adapted to flex to an outwardly generally convex position under pressure from within the container is provided with integral tripod-type support structure for the container in the bottom wall comprising an inwardly concave center portion of compound curvature having a generally equilateral triangular shaped bottom wall area extending generally radially outwardly therefrom and providing three equilaterally spaced support areas in the outwardly flexed convex position. Methods and apparatus for forming the integral tripod-type support structure comprise forming the concave center of compound curvature by a doming die with portions of the equilateral triangularly shaped bottom wall area located axially inwardly a lesser distance than other portions of the concave center in an inwardly flexed position so as to be located axially outwardly a greater distance than other portions of the bottom wall in an outwardly flexed position, thereby forming the tripod-type support structure on the bottom wall during movement from the inwardly flexed position to the outwardly flexed position under pressure of the contents of the can.

2 Claims, 16 Drawing Figures

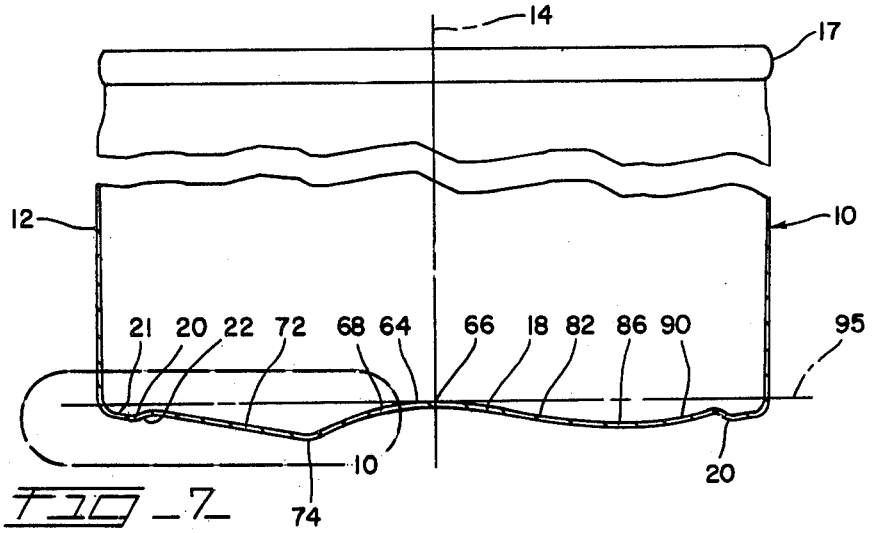
FIG. 7
FIG. 8
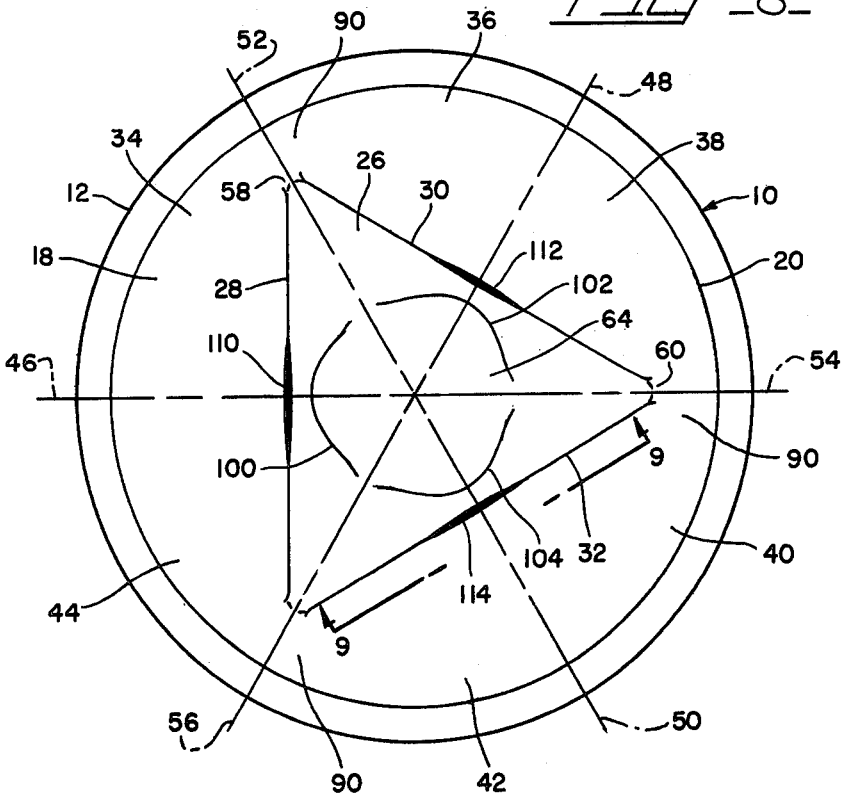

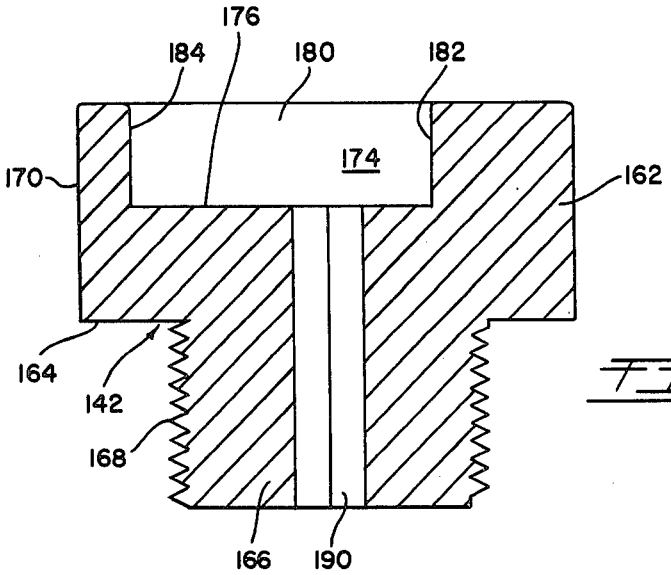
FIG. 14
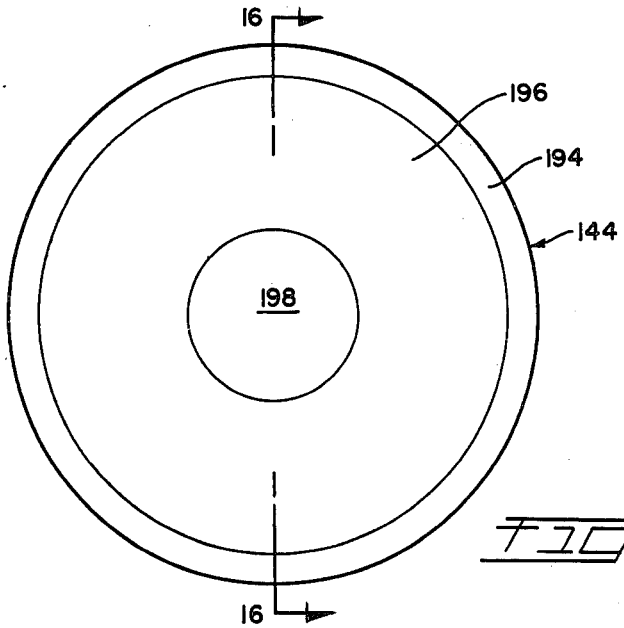
FIG. 15
FIG. 16
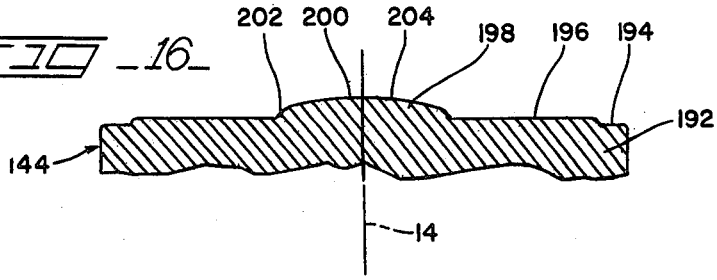

CONTAINER WITH OUTWARDLY FLEXIBLE BOTTOM END WALL HAVING INTEGRAL SUPPORT MEANS AND METHOD OF MANUFACTURE THEREFORE

This is a divisional of application Ser. No. 631,539, filed Nov. 13, 1975 now U.S. Pat. No. 4,037,752.

BACKGROUND AND SUMMARY OF THE INVENTION

This invention generally relates to containers and more particularly to two or three piece containers made of sheet metal material such as steel or aluminum.

The general concept of an outwardly flexible bottom wall in a metal container has been known at least since U.S. Pat. No. 2,894,844. Such a structure enables the use of less metal in the container, thereby reducing the cost of material. Various other configurations of container bottom end wall structures have previously been suggested as illustrated by U.S. Pat. Nos. 6,391; 79,692; 2,541,065; 2,847,144; 2,929,525; 3,043,461; 3,259,296; 3,430,805; 3,598,270; 3,690,507; and 3,871,541. In addition, a metallic container having a spherical dimple in an outwardly flexible bottom wall providing a continuous circular suppoort rim in an outwardly flexed position has been disclosed in U.S. Pat. No. 3,904,069.

The primary purpose of the present invention is to provide a can-type sheet metal container made of relatively thin sheet stock and having a relatively thin side wall and a relatively thin bottom wall so as to reduce material costs. In a container made of such thin material the bottom wall will be axially outwardly flexible when filled with goods under pressure such as beer, other carbonated beverages, or other consumer goods canned as for example in sanitary cans. In order to enable such containers to be supported in a vertically upright position, new and improved integral support means are provided in the bottom wall to be effective in the outwardly flexed position to provide very stable support for the container, while being capable of manufacture and filling in high speed production lines. Although various integral support structures have been previously proposed, the results have not always been satisfactory from the standpoint of displacement of internal volume inside the can, reliable stability, internal coatability and of ease of manufacture at high production speeds. In most presently utilized can structures, the bottom wall is relatively thick and has either a flat ribbed bottom surface providing support for the can or an axially inwardly extending concave configuration locating the center portions of the bottom wall axially inwardly of a bottom rim portion of the can. In an outwardly convex configuration portions of the bottom wall unpredictably extend varying axial distances beyond the bottom rim portion and because of the convex curvature produce an unstable condition when the can is placed on a flat support surface. In order to provide stability for such cans, it has been previously proposed to provide integral support means in the bottom wall portion effective in the outwardly convex configuration. However, it has been determined that in connection with the present invention there are inherent problems in the manufacture of such cans including obtaining uniform dimensional characteristics and uniform residual stresses in the bottom end wall so that each bottom end wall of mass produced cans will have the same or similar characteristics without resorting to exceptional manufacturing means for achieving metal control such as double acting domer cylinders, etc.

In the present invention, the bottom wall is manufactured and constructed in a manner to obtain uniform axial displacement during outward flexing while also providing for increased uniform stability of such cans in the outwardly flexed position. The central portion of the bottom wall is first formed into an axially inwardly extending concave portion of compound curvature within a central bottom wall area of polygonal configuration, an equilateral triangular area being presently preferred, and equilaterally spaced linear support areas are provided about the area of compound curvature in the portions of the bottom wall furthest axially outwardly deflected in the outwardly flexed position. In this manner, at least three support areas providing essentially point or short length line contact with a flat support surface are located between the bottom rim of the can and the central concave portion of the bottom wall so that the can is supported by relatively widely spaced relatively narrow width and short length support areas providing stability for the can. In the manufacture of cans having the aforedescribed construction, the central concave portion is formed in the bottom wall with a generally hemispherical doming die, and an ironing punch having a prismatic cavity of polygonal; preferably equilateral triangular, base section coaxially aligned with and surrounding the dome portion of the doming die when the ironing punch and doming die are in the closed position. Due to varying metal stress the inwardly concave central portion of the bottom wall thus formed is of compound curvature with a relatively short length radius extending from each of the support areas toward the central axis and a relatively long arcuate surface of relatively long length radius extending opposite each of the support areas from the central axis toward the apex portions of the polygon. The arrangement is such that when the bottom wall is subsequently flexed outwardly under pressure of the contents of the can, the support areas are located furthest axially outwardly and the adjacent areas are axially inwardly displaced relative thereto so that only the support areas contact a flat support surface for the can.

DESCRIPTION OF THE PREFERRED EMBODIMENTS

FIG. 7 is a side elevational view in cross-section of a container having the body member of FIGS. 1–3, and showing the bottom wall in an outwardly flexed position;

FIG. 8 is a bottom view of the container of FIG. 7;

FIG. 14 is another side elevational view in cross-section of the element of FIGS. 12–13 taken along the line 14—14 in FIG. 12;

FIG. 15 is a top view of another element of the apparatus of FIG. 11;

FIG. 16 is a partial side elevational view in cross-section of the element of FIG. 15 taken along the line 16—16 in FIG. 15;

Figure 1:
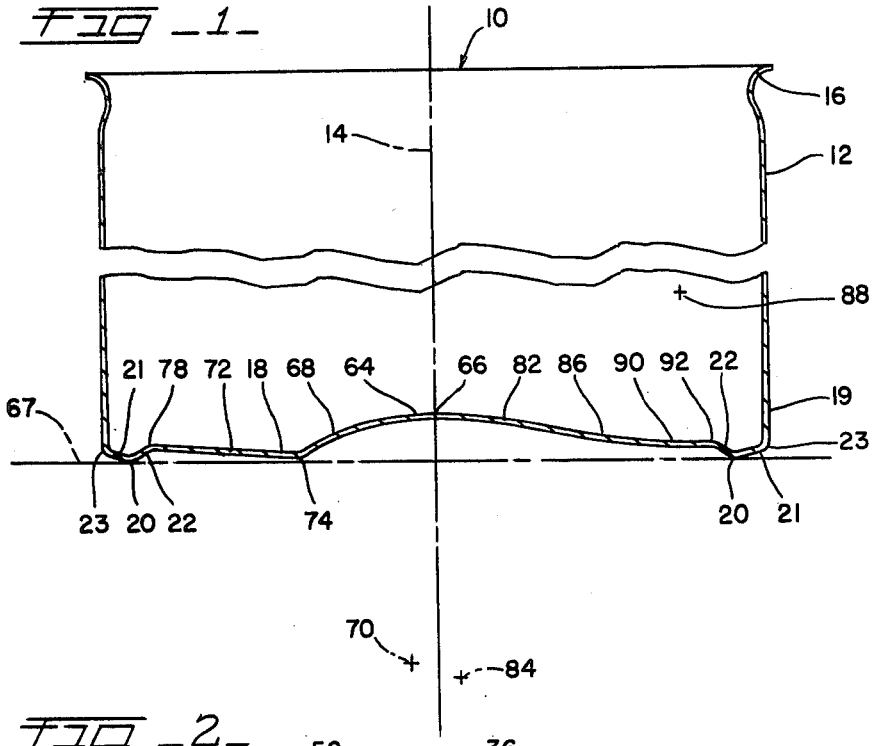
FIG. 1 is a side elevational view in cross-section of a one piece container body member of a two piece metallic container, with an intermediate central portion removed, as manufactured in accordance with the invention.
Figure 2:
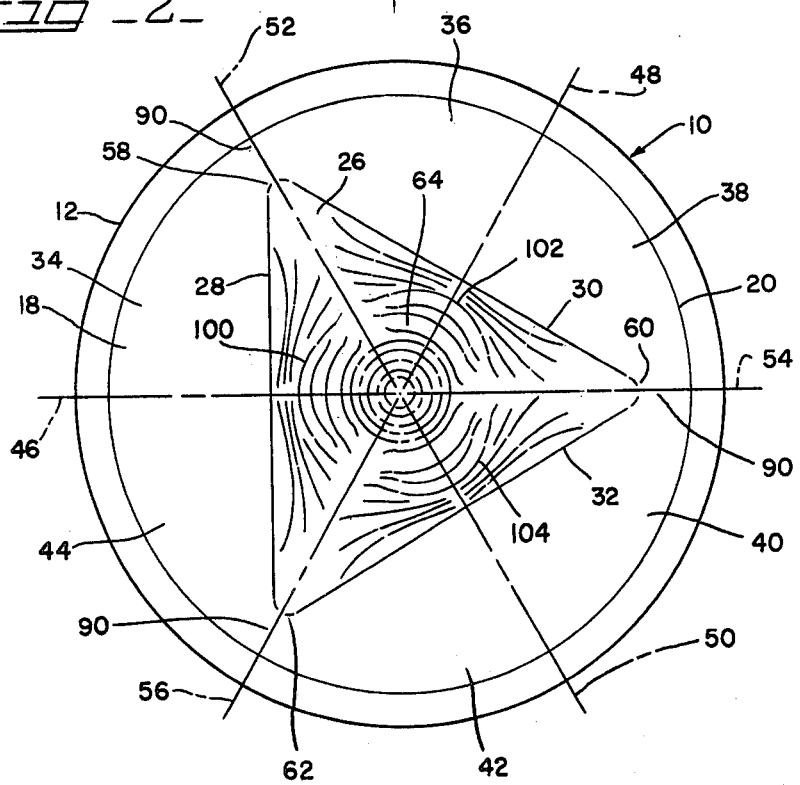
FIG. 2 is a bottom view of the container of FIG. 1.

Referring now to FIGS. 1 and 2, an illustrative cylindrical container body member 10, which may be of one piece construction for a two piece container assembly, is made of one piece of a relatively thin sheet material such as aluminum or steel. In the description and claims of the invention, the container body member and the container assembly thereof are generally referred to in a vertical upright position as normally located in use and storage. Thus the terms such as "upper", "top", "lower", and "bottom" refer to the vertical, upright position. In addition, the terms such as "axial" and "axially extending" refer to the central longitudinal axis of the container body member and a container assembly thereof. The terms such as "radial" and "radially extending" relate to the central longitudinal axis. The terms "inwardly" and "outwardly" relate to the central longitudinal axis and/or the inside and outsides, respectively, of the container body member and/or a container assembly formed therefrom. In an illustrative and presently preferred embodiment of the inventive concepts, container body member 10, a 16 oz. beverage container, is made from one piece of 3004-H19 sheet aluminum having an initial thickness of 0.0140 in. However, it is contemplated that the inventive concepts may be employed in containers made from various materials and with various dimensions. The container body member comprises a cylindrical side wall portion 12 having a central longitudinal axis 14. By way of example, in a 16 oz. size, the central side wall thickness may be approximately 0.0050 in., the outside diameter may be approximately 2.547 in. and the axial length after necking and flanging may be about 6.277 in. An integral flange portion 16 at the upper end of the container body member 10 is adapted to receive an upper end closure 17, FIG. 7. A relatively thin flexible bottom wall 18, having a general overall thickness of, for example, approximately 0.0140 in., is integrally connected to the lower end portion of the side wall 12 by an annular curved connecting portion 23. The inside surfaces of the lowermost portion 19 of the side wall 12 is preferably slightly inwardly tapered at an angle of approximately 1° to provide an increased wall thickness of for example approximately 0.0137 in. adjacent its juncture with the bottom wall 18 for additional strength as shown in FIGS. 5, 6.

Figure 5:
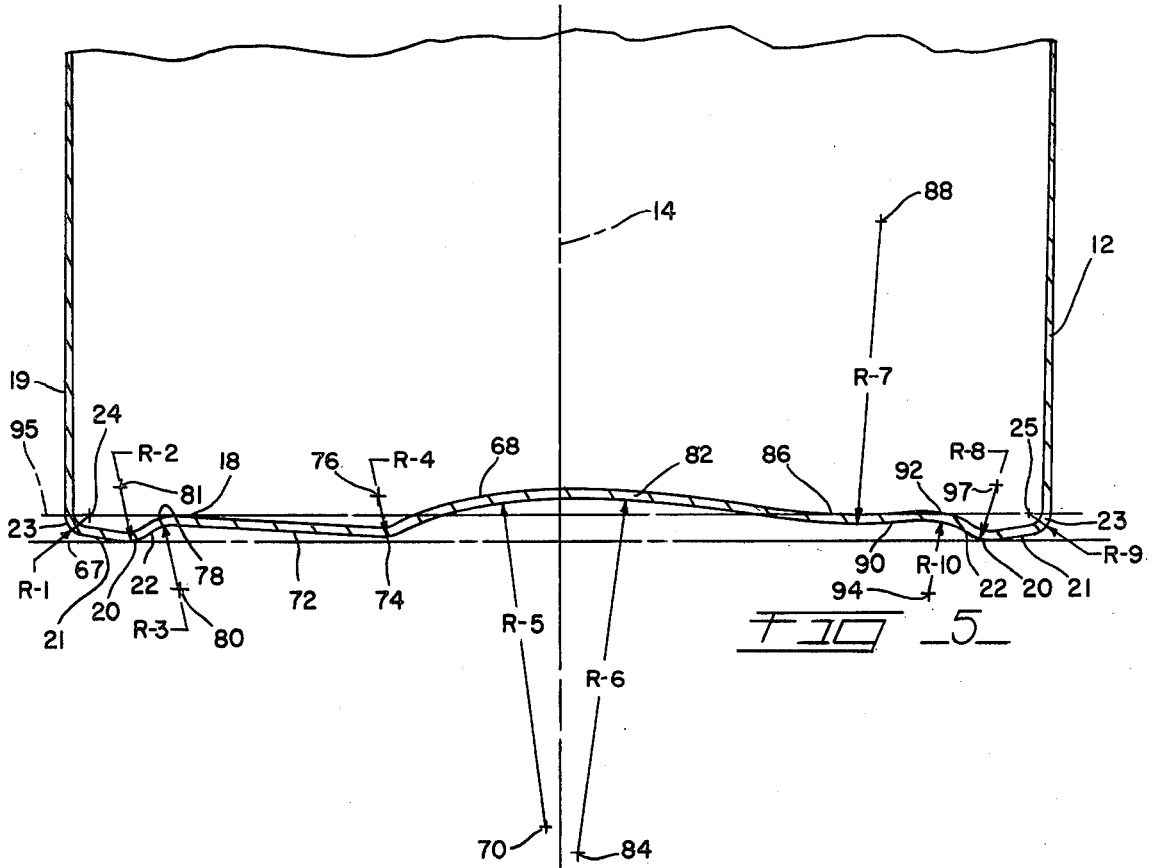
FIG. 5 is an enlarged cross-sectional view of the bottom wall of the container body member of FIG. 1.
Figure 6:
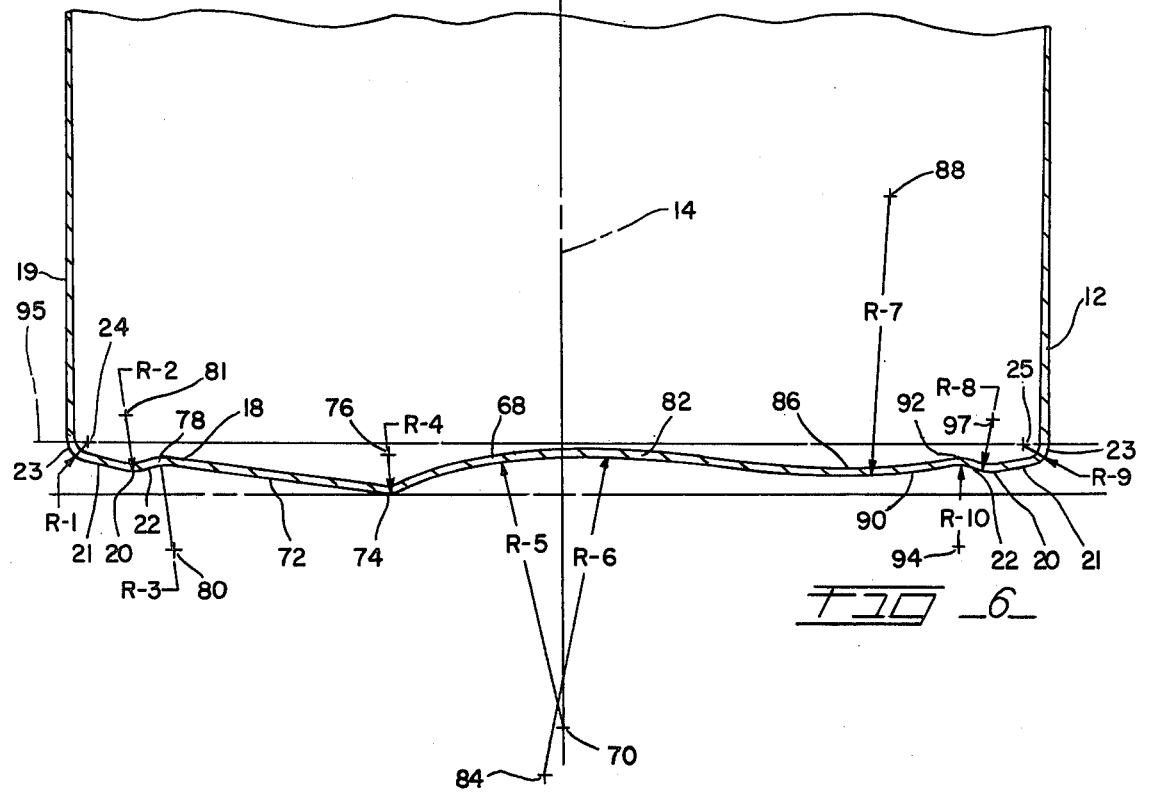
FIG. 6 is an enlarged cross-sectional view of the bottom wall of the container of FIG. 4.
Figure 9:
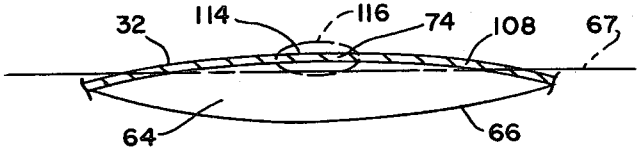
FIG. 9 is a partial cross-sectional view taken along line 9—9 in FIG. 8.

In the presently preferred embodiment, bottom wall 18 is provided with an outer annular curved rim portion 20 intermediate oppositely inclined flange portions 21, 22 with flange portion 21 being connected to side wall portion 19 by curved wall portions 23 having radii of curvature R1 and R9 with centers of curvature located at 24, 25 respectively, FIGS. 5, 6. Indentation means are provided in a central portion of the bottom wall within a polygonally shaped area of indentation 26 of compound curvature defined by generally linear edge surfaces 28, 30, 32, arranged in the form of an equilateral triangle such that there are six similarly shaped bottom wall areas 34, 36, 38, 40, 42, 44 defined by radial lines 46, 48, 50, and 52, 54, 56 extending through the midpoints of surfaces 28, 30, 32, respectively, and through the apex areas 58, 60, 62, respectively. In addition, the adjacent bottom wall areas 34, 44, and 36, 38, and 40, 42, between radial lines 52, 56, and 52, 54, and 54, 56, respectively define three similarly shaped bottom wall areas which extend between the rim portion 20 and each of the surfaces 28, 30, 32, and are interconnected by narrow width wall portions extending along radial lines 52, 54, 56.

The indentation means further comprises an axially inwardly extending concave dome-like wall portion 64 of compound curvature centrally located on the central axis 14 within surfaces 28, 30, 32, which provides a central inner surface portion 66 located further axially inwardly than any other inner surface portion of the bottom wall 18.

The compound curvature of the indentation means is essentially defined by the structure of the bottom wall portions extending along the radial lines 46–56 with the first structural form along radial lines 46, 48, 50 being the same and a second structural form along radial lines 52, 54, 56 being the same. It is to be noted that the arrangement is such that the overall bottom wall structure along colinear radial lines 46, 54, and 50, 52 and 48, 56 is the same, and, as will become apparent hereinafter, the varying curvatures of the bottom wall between the wall portions extending along the radial lines 46–56 are the same so that the variously curved bottom wall portions are symmetrically arranged.

Referring now to FIGS. 1 and 5, the bottom wall structure, as finally formed in can body member 10 prior to subsequent outward flexing after being filled with contents under pressure, along each of radial lines 46, 48, 50 (FIG. 2) is illustrated to the left of central axis 14 and along each of radial lines 52, 54, 56, to the right of central axis 14. In the finally formed position, the rim portion 20 provides an annular outer surface portion of bottom wall 18 generally located in a plane 67 transverse to central axis 14 further axially outwardly, e.g. approximately 0.010 inch from the outer surface of wall portion 74, than any other outer surface portion of the bottom wall or the side wall 12 to provide rigid stable support means for container body member 10 during a portion of subsequent processing and handling.

The dome-like concave wall portions 68, FIG. 5, along radial lines 46, 48, 50, have a relatively large radius of curvature R5 with a center of curvature located at 70 a substantial distance axially outwardly thereof adjacent and slightly transversely offset relative to axis 14 along the radial lines. Wall portions 68 are connected to generally radially inwardly, axially outwardly extending inclined flat wall portions 72, having an angle of inclination of, for example, approximately $2\frac{1}{3}°$ relative to plane 67, by curved wall portions 74 having a relatively small radius of curvature R4 with a center at 76. Wall portions 68 have a relatively large, e.g. approximately 20° to 25°, angle of inclination relative to plane 67 at the intersection with wall portion 74 for a purpose to be hereinafter described. Wall portions 72 are connected to wall portions 22 by curved wall portions 78 having a radius of curvature R3 with a center at 80.

The dome-like concave wall portions 82, FIG. 5, along radial lines 52, 54, 56, have a slightly larger radius of curvature R6 than wall portions 68, with a center of curvature at 84 located axially outwardly slightly beyond center 70 and transversely offset from central axis 14 along the radial lines 52, 54, 56 a slightly lesser distance than the offset of center 70. Wall portions 82 are connected to reversely curved convex wall portions 86 having the same radius of curvature R7 as concave wall portions 82 with a center of curvature at 88 located axially inwardly a substantial distance and transversely offset from center line 14 a substantial distance. At the intersection of curved wall portions 82, 86, the angle of inclination relative to plane 67 is substantially less, e.g. approximately $8\frac{3}{4}°$, than the angle of inclination of wall portion 68 relative to plane 67 for a purpose to be hereinafter described. Convexly curved wall portions 86 are connected to flange portion 22 by essentially flat intermediate wall portions 90 and curved wall portions 92 having a small radius of curvature R10 with a center at 94. The radius of curvature R8 of rim portion 20, with a center at 97, along radial lines 52, 54, 56 is slightly smaller, e.g. by approximately 0.015 in., than the radius of curvature R2 of rim portion 20, with a center at 81, along radial lines 46, 48, 50.

A presently preferred and illustrative dimensional arrangement for the bottom wall structure of FIGS. 1 and 5, in inches with Axial Offset measured from a plane 95 transverse to central axis 14 and including centers 24, 25 and Transverse Offset measured from central axis 14, is set forth in the following Table I:

TABLE I

| R-No. | Radius | Axial Offset | Transverse Offset |
|---|---|---|---|
| R 1 | .070 | .000 | 1.203 |
| R 2 | .185 | .1107 | 1.148 |
| R 3 | .580 | .629 | .951 |
| R 4 | .120 | .055 | .524 |
| R 5 | 1.028 | .980 | .018 |
| R 6 | 1.031 | .985 | .012 |
| R 7 | 1.031 | .970 | .886 |
| R 8 | .170 | .093 | 1.148 |
| R 9 | .070 | .000 | 1.209 |
| R 10 | .466 | .522 | .996 |

Figure 3:
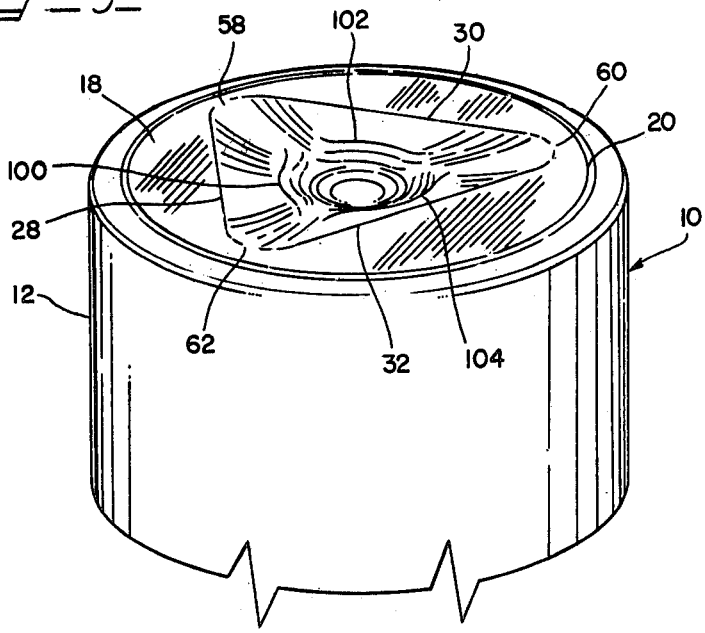
FIG. 3 is a perspective view of the lower portion of the container body member of FIG. 1 in an inverted position showing the bottom wall.
Figure 4:
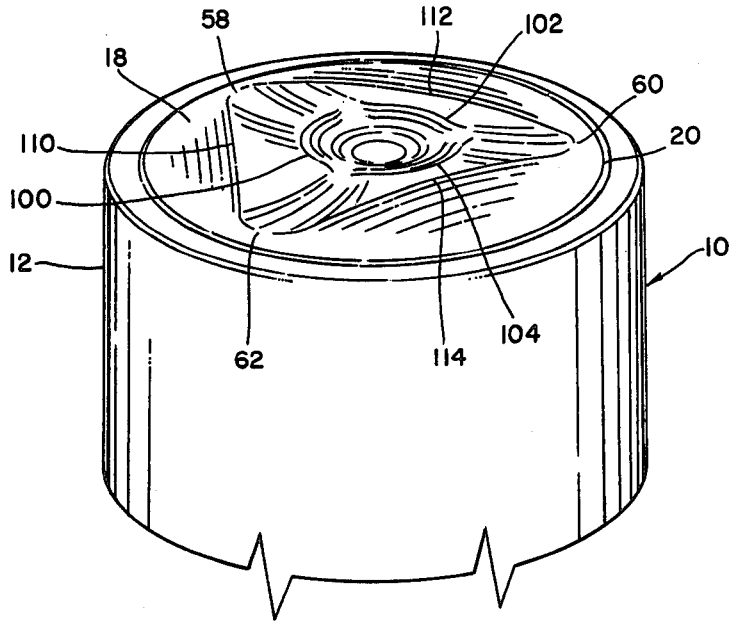
FIG. 4 is a perspective view of the lower portion of a container having the body member of FIGS. 1–3, in an inverted position showing the bottom wall after outward flexing of the bottom wall under pressure of the contents of the can.

Referring now to FIGS. 2 and 3, the structural arrangement of the can body member 10, prior to filling with contents under pressure such as to cause outward defection of the bottom wall 18, provides a central concave area of indenation 64 essentially defined by three sets of similarly curved outer surface segments 100, 102, 104 extending between radial lines 52 and 56, 52 and 54, 54 and 56, respectively. The sets of curved outer surface segments are essentially circular next adjacent the central axis 14 and the portions of the segments, adjacent to and extending radially outwardly, along radial lines 46, 48, 52 remain essentially circular to the area of intersection with wall portions 72 at linear surfaces 28, 30, 32 while the portions of the segments, circumferential spaced therefrom and extending circumferentially toward the radial lines 52, 54, 56 gradually change into more or less elliptical configuration merging with the curved wall portions extending along lines 52, 54, 56. At the apex areas 58, 60, 62, the linear surfaces 28, 30, 32 and the curved wall portions extending along lines 52, 54, 56 more or less merge with the intermediate flat wall portion 90 to provide a smooth outer surface area indicated by the dotted lines connecting linear surfaces 28, 30, 32. The structural arrangement provides cantilever-like support means for each of the linear surfaces 28, 30, 32 includng a first relatively short cantilever-like support wall portion extending generally radially inwardly from the adjacent section of the rim portion 20 about radial lines 46, 48, 50 between radial lines 52, and 56, 52 and 54, 54 and 56, respectively, and a second relatively long cantilever-like support wall portion extending generally radially inwardly from the opposite section of the rim portion 20 about radial lines 52, 54, 56 between radial lines 46 and 48, 48 and 50, and 46 and 50, respectively, beyond center axis 14 and including wall portions 68.

Referring now to FIGS. 4 and 6–9, a container assembly comprising the container body member 10 of FIG. 1–3 and 5 is shown after filling with a carbonated liquid, such as beer, and covering with an upper end closure 17. The bottom wall 18 is shown axially outwardly deflected from the position of FIGS. 1–3 and 5 by internal pressure of the contents of the container at, by way of illustration, approximately 35 psi and 70° F.

The outward deflection of the bottom wall changes the construction of the bottom wall as illustrated in detail in FIGS. 6 and 7 with only the radius of curvature R1, R9 of wall portions 23 and the centers of curvature 24, 25 thereof remaining in the same relative positions to side wall 12 as in FIGS. 1–3 and 5. The axial location of the outermost surfaces of rim portion 20 have been variably changed so that plane 67 as defined relative to FIGS. 1–3 and 5 is no longer transverse to the central axis. The bottom wall portions 34–44 are formed into a generally spherical configuration with linear surface portions 28, 30, 32 being located on curved wall sections 108, FIG. 9, to provide tripod support means in the form of three generally linear surface areas 110, 112, 114 in an area 116 at the midsections of linear surfaces 28, 30, 32 adjacent radial lines 46, 48, 50. As clearly shown in FIG. 8, the edge surfaces 28, 30, 32, when viewed from the bottom of the container in a plane transverse to central axis 14, extend linearly relative to the central axis 14 and rim portion 20. Thus, the terms "linear" and "linearly extending" as used herein in reference to edge surfaces 28, 30, 32 and surface areas 110, 112, 114 in the outwardly deflected configuration relates to the two dimensional configuration of those surfaces in a plan view thereof, it being recognized that those surfaces, as viewed in perspective or side elevation, such as in FIGS. 4 and 9, in a plane parallel to central axis 14, have a curvilinear configuration. The outermost portions of surface areas 110, 112, 114 are loated axially outwardly beyond plane 95 a distance of, for example, approximately 0.085 in. so as to be located axially outwardly further than any other outer surface areas of the bottom wall 18 on the side wall 12. As illustrated in FIG. 8, the support areas 110, 112, 114, appear to be somewhat elliptical and may be somewhat greater in width at the intersections with radial lines 46, 48, 50 while becoming narrower along curved lines extending therefrom and merging with linear surfaces 28, 30, 32.

Referring now to FIGS. 6 and 7, in the outwardly deflected position, the location of the centers of curvature of curved wall portions 23 is unchanged and remain in plane 95. The angle of inclination of flange portions 21 relative to plane 95 have changed with the flange portions 21 along radial lines 46, 48, 50 having a greater angle of inclination and the flange portions 21 along radial lines 52, 54, 56 having a smaller angle of inclination.

The radius of curvature R2 of rim portion 20 along radial lines 46, 48, 50 has been reduced, e.g. approximately 0.045 inch, and the center of curvature 81 has been shifted axially outwardly, e.g. approximately 0.0547 inch, and radially outwardly, e.g. approximately 0.014 inch.

The radius of curvature R3 of wall portions 78 along radial lines 46, 48, 50, has been increased, e.g. approximately 0.050 inch, and the center of curvature 80 has been shifted axially inwardly, e.g. approximately 0.026 inch, and radially outwardly, e.g. approximately 0.124 inch.

The angle of inclination of wall portion 72 relative to plane 95 has been increased from approximately $2\frac{1}{3}°$ to 9°.

The radius of curvature R4 of wall portion 74 has been decreased with the axial location of center of curvature 76 having been relocated from a position located axially inwardly of plane 95 to a position located axially outwardly therefrom. In addition, the transverse location of the center of curvature 76 has been moved radially inwardly a distance of approximately 0.006 inch. Consequently, support areas 110, 112, 114 are more sharply defined than in the construction of FIGS. 1–3 and 5 due to the reduced radius of curvature of wall portions 74.

The radius of curvature R5 of wall portions 68 has been increased, e.g. by approximately 0.196 inch, and the center of curvature 70 has been shifted axially outwardly, e.g. approximately 0.304 inch, and radially inwardly, e.g. approximately 0.017 inch, so as to be substantially coaxial with central axis 14. Thus, the curvature of wall portions 68 is such as to define essentially spherical wall segments in the concave dome-like area 64 which have a slightly greater angle of inclination relative to plane 95 at the intersection with wall portions 74 to more sharply define linear surfaces 110, 112, 114.

The radius of curvature R6 of wall portion 82 has been increased, e.g. approximately 0.019 inch more than the increase in the radius of curvature of wall portion 68, and the center of curvature 84 has been shifted axially outwardly, e.g. approximately 0.323 inch, further than the radius of curvature of wall portion 68, and radially inwardly, e.g. approximately 0.029 inch, beyond central axis 14 a distance of 0.017 inch. Thus, the centers of curvature 70, 84 have been shifted transversely in opposite radial directions and are now located on opposite radial sides of one another from the positions of FIGS. 1–3 and 5. The result is that wall portions 82 are more concave and have a greater angle of inclination relative to plane 95.

The radius of curvature R7 of wall portions 86 has been increased a relatively large amount, e.g. by approximately 0.558 inch, and the center of curvature 88 has been shifted axially inwardly, e.g. approximately 0.482 inch, a substantial distance and has been shifted radially inwardly, e.g. approximately 0.273 inch. The result is that wall portions 86 are more convex and have a greater angle of inclination relative to plane 95.

The radius of curvature R10 of wall portions 92 has been reduced, e.g. by approximately 0.086 inch, and the center of curvature 94 has been shifted axially inwardly, e.g. approximately 0.054 inch, and radially outwardly, e.g. approximately 0.063 inch. The result is that wall portion 92 is more concave and intersects wall portion 86 at a sharper angle.

The radius of curvature R8 of rim portions 20, along radial lines 52, 54, 56, has been reduced, e.g. by approximately 0.050 inch, and the center of curvature 97 has been shifted axially outwardly, e.g. approximately 0.61 inch, and radially inwardly, e.g. approximately 0.036 inch.

The illustrative dimensional relationships, in inches, of the radii of curvature and the centers of curvature in the outwardly deflected position are provided in Table II with "Axial Offset" measured from plane 95 and "Transverse Offset" measured from the central axis 14.

TABLE II

| R-No. | Radius | Axial Offset | Transverse Offset |
|---|---|---|---|
| R 1 | .070 | .000 | 1.203 |
| R 2 | .140 | .056 | 1.134 |
| R 3 | .630 | .603 | 1.075 |
| R 4 | .085 | .071 | .518 |
| R 5 | 1.224 | 1.284 | .000 |
| R 6 | 1.246 | 1.308 | .017 |
| R 7 | 1.589 | 1.452 | .613 |
| R 8 | .120 | .032 | 1.112 |
| R 9 | .070 | .000 | 1.209 |
| R 10 | .380 | .468 | 1.059 |

The length and width of the tripod support areas will vary depending on the material characteristics, the forming operations, and the pressure of the contents of the container. The essentially flat linear characteristics of the edge portions 28, 30, 32 of the area 26 in the pre-formed condition of FIGS. 1–3, change after outward deflection to provide axially outwardly rounded tripod support surfaces 110, 112, 114, which may have a somewhat elliptical peripheral configuration as illustrated in FIG. 8, with the axially outermost surface area being generally located at and centered about the intersections of radial lines 46, 48, 50 and edge portions 28, 30, 32. The tripod support surfaces are supported in cantilever-like fashion on one side, nearest the rim portion 20, by the relatively short length wall portions 72 and in cantilever-like fashion on the other side, furthest from the rim portion 20, by the wall portions 68, 82, 86, 90 of compound curvature along radial lines 52, 54, 56 which include a first radially outermost outwardly convexly curved portion 86, a second radially intermediate inwardly concavely curved portion 82, and a third radially innermost concavely curved portion 68 located at least in part approximately at or axially outwardly beyond the plane 95, and entirely axially inwardly beyond the surfaces 110, 112, 114.

Thus the central dome-like portion 64 retains its general concave configuration in the outwardly flexed condition with at least a portion thereof located in general alignment with plane 95 to provide sufficient strength in the bottom wall to reduce inward flexing and to rigidify the tripod support areas 110, 112, 114. The precise location of the axially innermost surface area 66 of the dome-like wall portion 64 in relationship to plane 95 will be dependent on the degree of outward flexing of the bottom wall as related to the internal pressure of the container.

Figure 10:
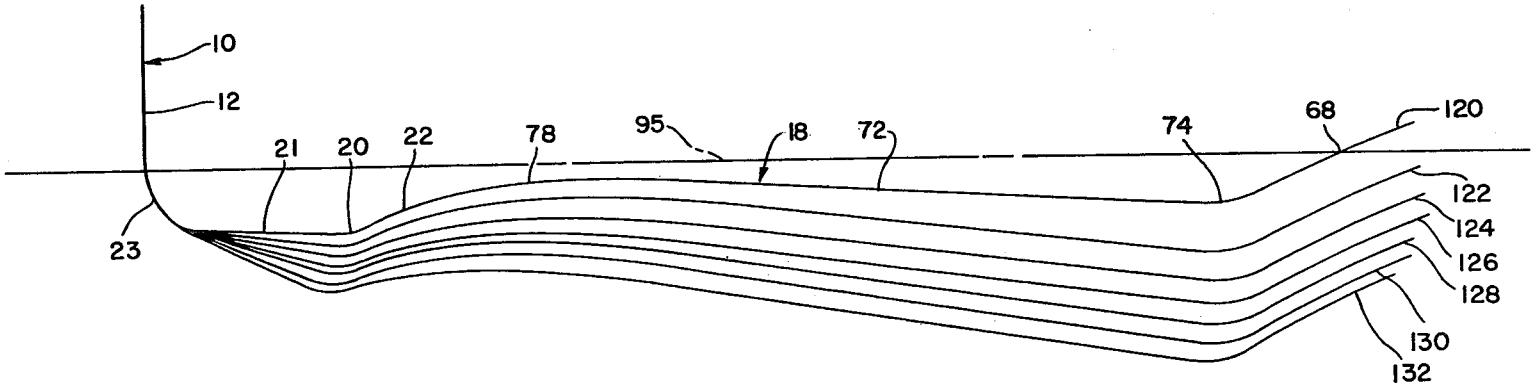
FIG. 10 is an enlarged schematic side view of the portion of the container enclosed within dashed line 10 of FIG. 7 showing a portion of the bottom wall in varying positions of outward deflection.

The configuration of the bottom wall in the outwardly deflected position is dependent on the container body member's initial configuration as illustrated in FIGS. 1–3 and 5, and on the degree of subsequent outward deflection of the bottom wall. Referring now to FIG. 10, for a container body 10 made of 3004-H19 sheet aluminum having an initial bottom wall thickness of approximately 0.0140 in. and other dimensions as previously described, the bottom wall portion 18 is shown to be axially outwardly deflectable from an initial position at 120 to various outwardly deflected positions at 122, 124, 126, 128, 130, 132, as the internal pressure of the container is increased from 0 psi to 10, 20, 30, 40, 50, 60 psi, respectively. The degree of axially outward deflection in inches of the tripod support areas 110, 112, 114 from the plane 95 is shown in the following Table III.

TABLE III

| Internal Pressure (psi) | Axial Outward Location | Change In Location |
|---|---|---|
| 0 | 0.065 | .000 |
| 10 | 0.115 | .050 |
| 20 | 0.139 | .024 |
| 30 | 0.159 | .020 |
| 40 | 0.177 | .018 |
| 50 | 0.196 | .019 |
| 60 | 0.210 | .014 |

Thus, as pressure is increased the amount of deflection increases at a generally decreasing rate due to the configuration of the bottom wall portion and residual stresses therein. The degree of outward deflection of the bottom wall is further dependent on the thickness and nature of material used. For example, a similar aluminum container body having an initial bottom wall thickness of approximately 0.0130 in. will axially outwardly deflect to a greater degree than the container of Table 1, while a similar aluminum container body having an initial bottom wall thickness of approximately 0.0150 in. will axially outwardly deflect to a lesser degree than the container of Table 1.

Referring now to FIGS. 11–16, apparatus for forming the container body member 10 of FIGS. 1–3 and 5, is shown to comprise a movable punch means in the form of a punch member 140, a first die means in the form of a die member 142 mounted on and movable with the punch member 140, and a second die means in the form of a die member 144 mounted in fixed relationship to the punch member 140 and the first die means 142. The punch member 140, first die means 142 and second die means 144 are associated with conventional body making machine apparatus (not shown).

The punch member 140 comprises a cylindrical side surface 146, e.g. approximately 2.541 inch diameter, the bottom end portion 147 of which is radially inwardly tapered at an angle of 1°, engageable with the inner side surface 148 of side wall portion 12, an annular rim portion 150 at the lower end providing an annular outwardly facing forming surface 152, and an annular die member cavity 154 between a cylindrical side wall surface 155, with a conical wall surface 156 connected to an enlarged annular wall surface 158, and die member 142. In an alternate embodiment (not shown), sidewall surface 155 may be extended toward forming surface 152 so as to terminate in a plane defined by annular bottom wall surface 172 of die member 142 thereby eliminating conical wall surface 156 and the relatively large gap 160 and shortening enlarged annular wall surface 158.

The die member 142 comprises an enlarged annular head portion 162 of, for example, 2.0 inch diameter, having a transverse annular abutment shoulder 164 for abutting engagement with the bottom wall (not shown) of the cavity 154 of the punch member and an attachment shaft portion 166 provided with threaded fastening means 168 for threaded engagement in a threaded bore (not shown) in the punch shank or ram (not shown). The cylindrical side wall surface 170 of head portion 162 is spaced from the side wall surfaces 155, 156, 158 of the punch member to define the relatively large gap 160. The annular bottom wall surface 172 is located axially inwardly of annular surface 152 a distance of, for example, 0.045 inch. A prismatic forming cavity 174 preferably having a generally equilateral triangular cross-sectional configuration is centrally located in the head portion 162 in symmetrical relationship to the central axis 14. Cavity 174 is defined by a transverse bottom wall portion 176 located axially inwardly from surface 172 a sufficient distance to prevent contact with the bottom wall 18 of the container body member and three axially extending side wall surfaces 178, 180, 182 connected by rounded axially extending side wall surfaces 184, 186, 188. The intersections of wall surfaces 178–188 with wall surface 172 are slightly rounded and define linear forming edge surfaces by which the linear edge surfaces 28, 30, 32, are formed in the container bottom wall 18. An axially extending passage 190, having a hexagonal cross-sectional configuration to receive a tool such as an Allen wrench for mounting and removal of the die member 142, is connected to a passage (not shown) in the ram member for selective application of high pressure air to cavity 174 from a conventional source of pressurized air (not shown) to assist in removal of the formed can body member 10 from the punch member 140 at the end of the forming operation.

The die member 144 comprises an annular body portion 192, e.g. of approximately 2.50 inch diameter having a contoured upper surface including an annular flat outer peripheral surface portion 194, an annular flat intermediate surface portion 196, e.g. of approximately 2.160 inch outside diameter axially outwardly offset approximately 0.020 inch from surface portion 194, and a centrally located domed portion 198 having an annular periphery, e.g. of approximately 0.880 inch diameter, with a forming surface 200 of compound curvature which is axially offset from surface 194 at central axis 14 a distance of approximately 0.165 inch. Surface 200 is of compound curvature with surface areas 202 adjacent intermediate surface portion 196 having a radius of curvature of approximately 0.175 inch with centers of curvature of approximately 0.175 inch with centers of curvature axially offset from surface 195 a distance of approximately 0.063 inch and transversely offset to the left of central axis 14, FIG. 16, a distance of approximately 0.288 inch, and with surface areas 204 in the central portion of forming surface 200 having a radius of curvature of approximately 0.990 inch with centers of curvature axially offset from surface 194 a distance of approximately 0.825 inch while being located on central axis 14.

Figure 11:
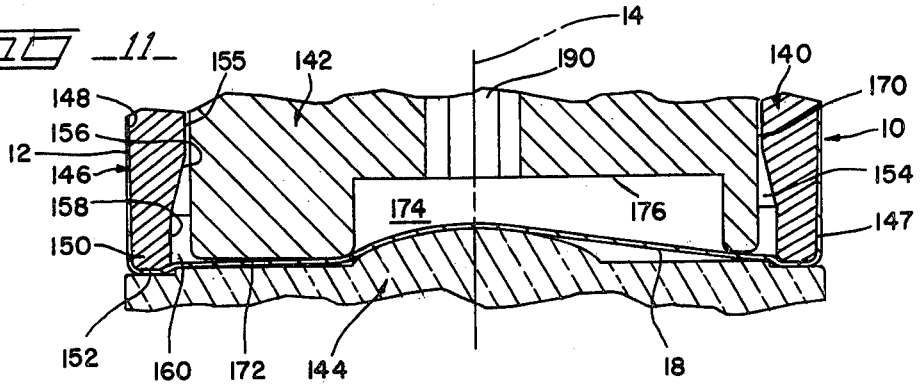
FIG. 11 is a partial side elevational view in cross-section of a container body member and apparatus for forming the bottom wall thereof as shown in FIGS, 1–3 and 5.
Figure 12:
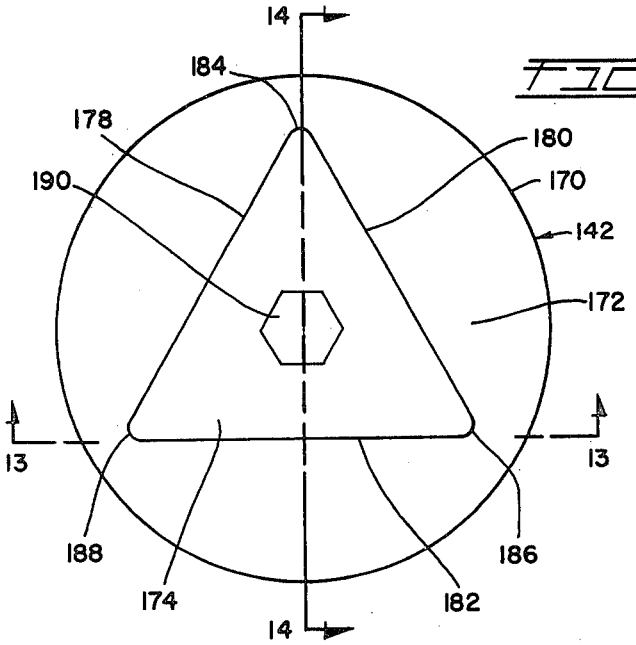
FIG. 12 is a bottom end view of a forming element of the apparatus of FIG. 11.
Figure 13:
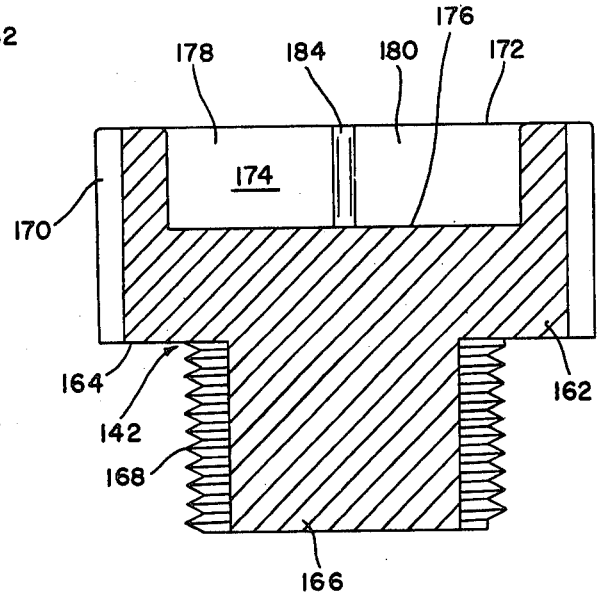
FIG. 13 is a side elevational view in cross-section of the element of FIG. 12 taken along the line 13—13 in FIG. 12.

Referring to FIG. 11, the structure of the bottom wall 18 of FIGS. 1–3 and 5 is formed in a two stage process during the terminal portions of the movement of punch member 140, by which the container body member 10 is drawn and ironed into the general configuration of FIG. 1, and after the forming forces applied by the punch member 149, die member 142 and die member 144 have been removed. As the punch member 140 and the die member 142 are moved toward the die member 144, the central portion of the bottom wall 18 first engages the central portion of dome portion 198 of die member 144. As the movement of punch member 140 and die member 142 continues, the dome portion 198 of die member 144 causes axial inward deflection of the bottom wall 18 with both permanent and temporary elongation of material and some initial permanent deformation in the central dome area of the bottom wall. After continued movement of the punch member 140 and the die member 142 approximately 0.025 inch surface 172 begins to contact the inner surface of the bottom wall portion adjacent the edge surfaces 178, 180, 182 of cavity 174 to begin formation of curved wall portions 74 and linear edge surfaces 28, 30, 32 while the central dome area of the bottom wall continues to be formed. Then, the outer peripheral edge of surface 196 and surface 194 are brought into engagement with outer peripheral portions of the bottom wall 18 to begin formation of curved wall portions 78 and 92. As the movement of the punch member 140 and the die member 142 continues, the outer peripheral portion of the bottom wall is held between surface 152 of punch member 140 and surface 194 of die member 144, the curved wall portions 78, 92 are further formed over the rounded outer peripheral edge of surface 196 into gap 160, the radially inward most part of wall portions 72 are forced toward surface 196 by inner peripheral portions of surface 172 without engagement with axially adjacent portions of surface 196, and the preliminary forming of dome portion 64 is completed.

After formation of the container body member 10, as shown in FIG. 11, the punch member 140 and die member 142 are moved away from die member 144. During such movement, the can body member 10 is removed from the punch member 140 by conventional stripper fingers (not shown) engageable with the open end of the can, and, in the presently preferred embodiment, by application of compressed air to the inner surface of the bottom wall 18 through cavity 174 and passage 190 or at least by connecting cavity 174 to the atmosphere through passage 190 to prevent creation of a vacuum in chamber 174 which would impede removal of the container body member.

The arrangement of the apparatus is such as to impart residual forming forces in the bottom wall which are effective upon removal of the foaming forces, by separation of punch member 140 and die member 142 from the final forming relationship with die member 144, to further change the configuration of the bottom wall 18 to the configuration depicted in FIGS. 1–3 and 5. When the forming forces are removed, the bottom wall 18 deflects axially outwardly with wall portion 72 moving from the radially axially inwardly inclined position of FIG. 11 to the radially inwardly axially outwardly inclined position of FIGS. 1, 5. As a result, the curved wall portion 78 and the curved rib portion 20 are oppositely axially displaced causing a reduction in radius of curvature and forming flange portions 21, 22. As another result, the curved wall portion 74 is moved axially outwardly causing a reduction in radius of curvature while further delineating edge surfaces 28, 30, 32. Upon removal of the forming forces and axial outward deflection of the bottom wall 18, the relatively long wall portions extending along radial lines 52, 54, 56, the intermediate portions of which are substantially linear upon completion of the forming operation shown in FIG. 11, are formed into reversely curved wall portions 82, 86 by the interaction of the permanent deformation in the dome area 64, the axial outward deflection forces and the preliminary curvature of wall portion 92. As a result, the curved wall portion 92 is moved slightly axially inwardly and radially outwardly causing a reduction in radius of curvature while further delineating edge surfaces 28, 30, 32. As a further result, the curved portion 92 and curved rib portion 20 are oppositely axially displaced causing a reduction in radius of curvature while forming flange portions 21, 22. The residual forces in the bottom wall 18 are effective to further form the bottom wall into the configuration of FIG. 1 because of the varying areas of the various wall portions, the varying radial lengths of the various wall portions, the location of the various curved wall portions, and the varying resistances of the various wall portions, such as the domed portion 64 and the curved portions 23, 74, 78, 92, to axial outward deflection of the bottom wall 18 upon removal of the forming forces. In addition, the tapered lower end portion 19 of the side wall 12 provides increased wall thickness for additional strength resisting the outward deflection of the bottom wall 18.

It is to be understood that the foregoing description of the configuration of the bottom wall 18 of the container body member 10, especially the compound curvatures thereof as well as of the doming portion 198 of die member 144, has been limited to the essential characteristics thereof, as required to enable the man of ordinary skill in the art to understand and practice the invention which has been actually reduced to practice in accordance with the foregoing description. Similarly, while the exact relationships of the various portions of the bottom wall 18 and the interaction of those portions in obtaining the configuration of FIGS. 1–3 and 5 may not be fully understood at this time or completely hereinbefore, the foregoing description of the apparatus and methods of manufacture of a container body member 10 having the configuration of FIGS. 1–3 and 5 have been actually reduced to practice in accordance with the foregoing description. Furthermore, containers having the bottom wall structure of FIGS. 4 and 6–8 have also actually been reduced to practice in accordance with the foregoing description.

While inventive concepts have been herein disclosed in reference to a presently preferred and illustrative embodiment of the invention, it is contemplated that these concepts may be variously employed in alternate structural arrangements in bottom walls of containers made of various materials by various apparatus and methods. For example, the dimensions disclosed herein are illustrative of a presently preferred container made of sheet aluminum having an initial thickness of approximately 0.0140 in. These dimensions may be varied to enable use of various materials and to obtain various structural characteristics as necessary or desirable to meet various requirements in use. The inventive concepts may be variously otherwise employed in containers made of other metallic materials, as for example, sheet steel and it is contemplated that certain of the inventive concepts may be utilized in containers made of plastic or composite materials wherein the bottom wall configuration of FIGS. 1–3 and 5 could be formed by conventional molding methods. In addition, some of the inventive concepts may be employed in containers having more than three support areas in the bottom wall, as for example quadrapod support areas, pentapod support areas, etc. Thus, it is intended that the appended claims be construed to cover alternate embodiments of the inventive concepts except insofar as precluded by the prior art.

What is claimed is:

1. A method of forming integral support structure in the bottom wall of a metallic container comprising:

firstly engaging the outer surface of the bottom wall with a first force applying tool having a centrally located protruding convexly curved dome-like area and forming a central wall area of indentation in the bottom wall of generally concave curvature;

secondly engaging the inner surface of the bottom wall with a second force applying tool having a polygonally shaped central cavity defined by elongated peripheral edge surfaces; and thirdly applying additional force to the outer surfaces of the bottom wall with said curved dome-like area on said first force applying tool and thereby further forming said central wall area of indentation in the bottom wall in said cavity without engagement of the inner surface of the bottom wall in said central area of indentation with said first force applying tool and simultaneously forming elongated peripheral edge surfaces on the outer surfaces of the bottom wall about said central wall area of indentation.

2. The invention as defined in claim 1 which further comprises:

setting centrally located portions of said central wall area of indentation while stretching surrounding peripheral portions of said central wall area during the third step;

setting peripherally located portions of the bottom wall during the third step;

fourthly removing the forces applied by said first force applying tool and said second force applying tool; and fifthly further forming the central wall area of indentation and the surrounding peripheral portions in the bottom wall to enable axially outward deflection of the bottom wall to an axially outwardly deflected position whereat at least portions of the elongated peripheral edge surfaces are located further axially outwardly than any other surface are located further axially outwardly than any other surface areas of the container.

* * * * *

UNITED STATES PATENT AND TRADEMARK OFFICE

CERTIFICATE OF CORRECTION

PATENT NO. : 4,096,814

DATED : June 27, 1978

INVENTOR(S) : Joseph Francis Dulmaine & Michael Edward Bagrosky

It is certified that error appears in the above-identified patent and that said Letters Patent are hereby corrected as shown below:

Column 1, line 25, "suppoort" should be --support--

Column 2, line 26, the semicolon (;) should be a comma (,)

Column 3, line 10, after "FIGS" the comma (,) should be a period (.)

Column 6, line 59, "loated" should be --located--

Column 8, line 13, "0.61" should be --0.061--

Column 10, line 55, the line should be cancelled - it is a repeat of line 54

Column 10, line 56, "195" should be --194--

Column 11, line 3, "149" should be --140--

Column 11, line 51, "foaming" should be --forming--

Signed and Sealed this

*Twenty-eighth* Day of *November 1978*

[SEAL]

*Attest:*

RUTH C. MASON
*Attesting Officer*

DONALD W. BANNER
*Commissioner of Patents and Trademarks*